US005456387A

United States Patent [19]

Trewhella

[11] Patent Number: 5,456,387

[45] Date of Patent: Oct. 10, 1995

[54] MACHINE FOR DISPENSING CHILLED ALCOHOLIC BEVERAGE HAVING IMPROVED COOLING CIRCUIT AND BOTTLE MOUNTING SYSTEM

[76] Inventor: Joseph M. Trewhella, 5008 Cavalier Ct., Godfrey, Ill. 62035

[21] Appl. No.: 237,816

[22] Filed: May 4, 1994

[51] Int. Cl.[6] ..... B67D 5/62

[52] U.S. Cl. ..... 222/146.6; 222/333; 222/503; 62/396

[58] Field of Search ..... 222/135, 136, 222/145, 146.6, 333, 505, 517, 508, 185; 62/389, 396, 390

[56] References Cited

U.S. PATENT DOCUMENTS

| | | | |
|---|---|---|---|
| D. 306,258 | 2/1990 | Liss | D9/447 |
| D. 307,709 | 5/1990 | Liss | D9/300 |
| 2,669,947 | 2/1954 | Ballew | 222/333 |
| 2,777,675 | 1/1957 | Stelzer et al. | 222/333 |
| 4,537,332 | 8/1985 | Brown et al. | 222/333 |
| 4,610,145 | 9/1986 | Arzberger et al. | 62/390 |
| 4,742,939 | 5/1988 | Galockin | 222/68 |
| 4,925,068 | 5/1990 | Schneider | 222/484 |
| 4,949,552 | 8/1990 | Adams | 62/393 |
| 5,033,648 | 7/1991 | Nakayama et al. | 222/506 |

*Primary Examiner*—Andres Kashnikow
*Assistant Examiner*—Philippe Derakshani
*Attorney, Agent, or Firm*—Morgan & Finnegan

[57] ABSTRACT

A machine dispenses chilled alcoholic beverage and has a housing forming an enclosure and outer surface. A refrigeration unit is contained within the housing and includes a compressor, condenser and evaporator coil. A beverage faucet is mounted on the outer surface of the housing and at least one inclined beverage container is mounted on the housing. A manifold is mounted in the housing for receiving beverage from the inclined beverage container. A beverage delivery tube is contained within the housing and operatively connects to the beverage faucet and manifold for delivering beverage from the manifold to the beverage faucet. A portion of the beverage delivery tube extends coaxially within the evaporator coil to form a chilled beverage line so that the beverage flowing through the beverage delivery tube is chilled. The housing also includes bottle mounts thereon which extend from the manifold upward through the housing and which are configured to receive a stopper shaft of a bottle stopper inserted within a beverage container.

11 Claims, 4 Drawing Sheets

MACHINE FOR DISPENSING CHILLED ALCOHOLIC BEVERAGE HAVING IMPROVED COOLING CIRCUIT AND BOTTLE MOUNTING SYSTEM

FIELD OF THE INVENTION

This invention relates to a machine for dispensing chilled beverage, and more particularly to a machine for dispensing chilled beverage which includes a refrigeration cooling unit, and a beverage delivery tube which is cooled by the refrigeration cooling unit, and an improved bottle mounting system.

BACKGROUND OF THE INVENTION

In one known cooling system for alcoholic beverages, a chiller coil is in intimate contact with the evaporator coil of a refrigeration cooling unit, and a constant vapor pressure is maintained on the refrigerant in the evaporator coil so that the coolant in the chiller coil is cooled to a substantially constant temperature. The chiller coil, evaporator coil, and associated equipment are contained in a closed housing.

An example of this type of unit is disclosed in U.S. Pat. No. 4,949,552, to Adams, assigned to Perfection Equipment, Inc. of Gurney, Ill. This type of unit is advantageous because the temperature of the beverage, such as beer, can be maintained at a constant range, and only a small amount of bath coolant is required. An insulated container may be used to hold the coolant. The container acts as a holding tank for the coolant and no refrigeration takes place in the tank. Part of a chiller coil extends from the housing and is used to chill beer lines which may be placed concentric about the chiller line. The unit can be placed out-of-sight and the beer lines can extend a few feet from the housing to a tap, or spigot.

Although this type of unit is advantageous for long beer line runs from a backroom area to a spigot, with some beverages it is still more desirable to dispense from a bottle. For example, some specialty beverages, or liqueurs, are viscous and have higher alcohol contents, i.e. about 35%, than most beers and wines. These liqueurs are often bottled in artistically designed bottles, and placed on compact, artistically designed dispensing machines which are readily visible to the public. The bottles are inverted, mounted on the machine, and the beverage withdrawn from the bottles on the machine.

Often these specialty beverages are served chilled to temperatures below freezing, i.e. about 15° F. Adequate chilling of the beverage is necessary, while also maintaining the bottles on display and positioned on top of the machine housing in an inclined or inverted position to allow beverage withdrawal. Thus, it is necessary to withdraw liqueur from the bottles periodically while: 1) ensuring that the bottles are displayed on the housing such as in an inclined (e.g. slanted or inverted) state to allow the viscous liquid to flow therefrom, 2) ensuring that the dispensed liqueur is adequately cooled even in times of high usage and dispensing activity, and 3) ensuring adequate control when dispensing the viscous beverage.

SUMMARY OF THE INVENTION

The present invention provides advantageous features and advantages over prior art devices. The machine of the present invention dispenses chilled alcoholic beverage and provides adequate cooling to the beverage. Controlled delivery of viscous alcoholic beverage such as a thick liqueur, is ensured while maintaining a smaller housing which is necessary if the bottles are to be displayed on the housing in an environment such as a public bar. Additionally, the machine has an improved bottle mounting system and stopper system so that any bottles that are inclined or inverted will not spill beverage until the bottles are adequately positioned on the machine. In accordance with the present invention, the machine maintains adequate flow control over the liqueur even when it is chilled to low temperatures and becomes viscous with a consistency similar to honey.

In accordance with the present invention, the machine dispenses chilled alcoholic beverages and has a housing forming an enclosure and an outer surface. A refrigeration cooling unit is contained within the housing and includes a compressor, condenser and evaporator coil. A beverage faucet is mounted on the outer surface of the housing.

A bottle mount is positioned on the top portion of the housing and mounts at least one inclined, preferably inverted, beverage container on the housing, and a manifold is mounted in the housing to receive beverage from the inclined beverage container mounted on the housing. A beverage delivery tube is contained within the housing and is operatively connected to the beverage faucet and beverage receiving means for delivering beverage from the beverage receiving means to the beverage faucet.

A portion of the beverage delivery tube extends coaxially within the evaporator coil to form a chilled beverage line so that the beverage flowing through the beverage delivery tube will be chilled. In one aspect of the invention, the chilled beverage line includes an egress point from which the beverage delivery tube exits from the evaporator coil. The egress point is positioned at a vertical height approximate to the vertical height of the beverage faucet. The chilled beverage line is preferably horizontally oriented and positioned within the top portion of the housing and is at a vertical height approximate to the vertical height of the beverage faucet. This facilitates maintenance of the system because the chilled beverage line can be purged during cleaning and maintenance. The horizontal configuration also helps prevent air pockets from forming during purging.

In one aspect of the invention, the housing has side and top surfaces. The beverage faucet is mounted on one side of the housing and a beverage manifold is mounted in the housing and the top portion thereof for receiving beverage. At least one bottle mount extends from the manifold upward through the housing. Each bottle mount is configured for receiving a stopper shaft of a bottle stopper inserted within a beverage container. The bottle stopper is formed of a hollow shaft with two opposing ends. One end of the shaft is adapted to extend into the neck of a container. The other end has a side opening.

A collar is mounted on the shaft and the collar is movable thereon from a closed position where the collar covers the opening to prevent beverage withdrawal, to an open position where the collar uncovers the opening to allow beverage withdrawal when that end is inserted within the bottle mount. The collar includes a tapered portion that engages a corresponding tapered portion of the bottle mount.

The shaft includes at least one O-ring for sealing between the collar and the shaft to prevent leakage in the closed position. The O-ring is positioned above and below the side opening of the shaft.

A portion of the beverage delivery tube is coaxial with the evaporator coil to form a chilled beverage line. A pump is interposed within the beverage delivery tube and pumps beverage to the beverage faucet.

An electrical switch actuates on-off operation of the pump. The beverage faucet includes a handle pivotally mounted thereon and a push rod extends from the handle to the electrical switch. The switch is responsive to pivotal movement of the handle for actuating operation of the pump. The switch is responsive to forward pivoting movement of the handle so that the push rod engages the switch to actuate the pump. A spring biases the push rod away from the switch. A bracket supports the push rod and the spring aids in returning the push rod to an initial "off" position.

BRIEF DESCRIPTION OF THE DRAWINGS

The advantages of the present invention will be appreciated more fully from the following description, with references to the accompanying drawings in which.

DETAILED DESCRIPTION OF THE INVENTION

Figure 1:
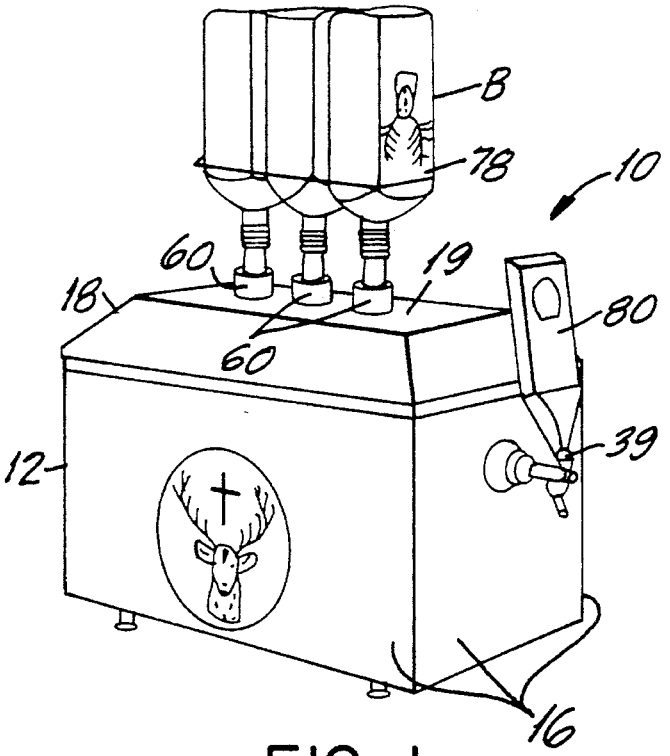
FIG. 1 is an environmental view of the machine of the present invention which dispenses chilled alcoholic beverage.

Referring now to FIG. 1, there is illustrated at 10 an environmental view of the machine for dispensing chilled alcoholic beverages in accordance with the present invention. As illustrated in greater detail in FIG. 2, the machine 10 includes a generally rectangular configured housing 12 that forms an enclosure 14 and has a outer surface with sidewalls 16 and a top surface 18, which has upwardly inclined walls converging to a flat top 19.

Figure 2:
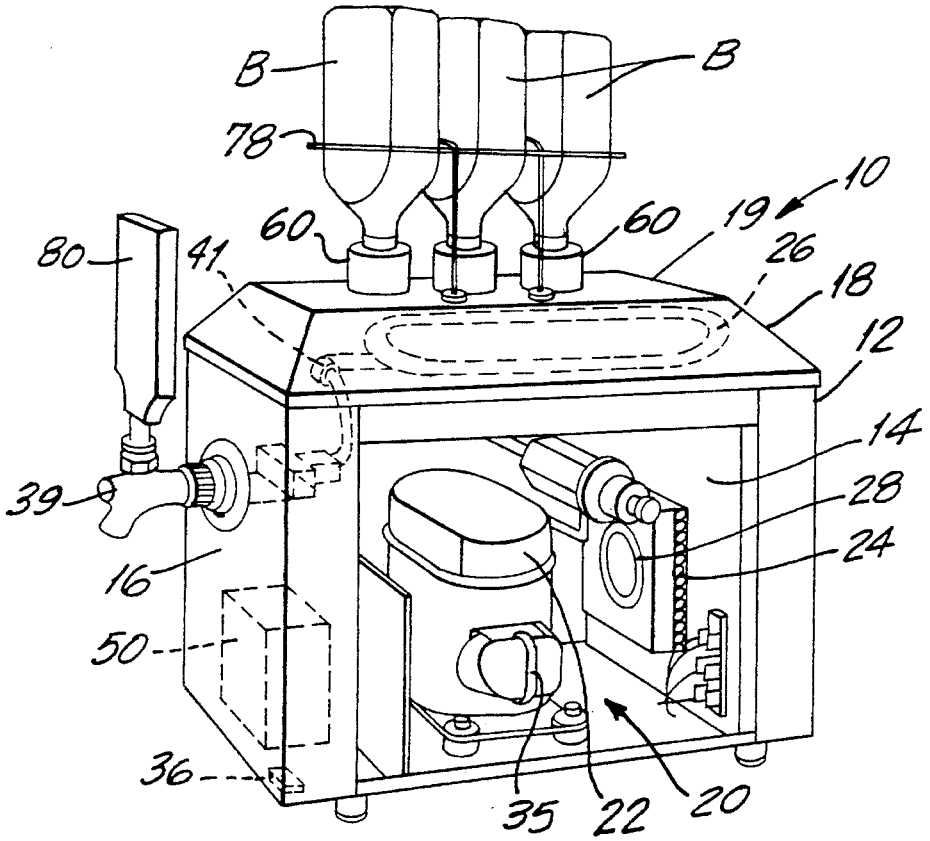
FIG. 2 is an isometric view of the machine showing internal parts of the machine.
Figure 5:
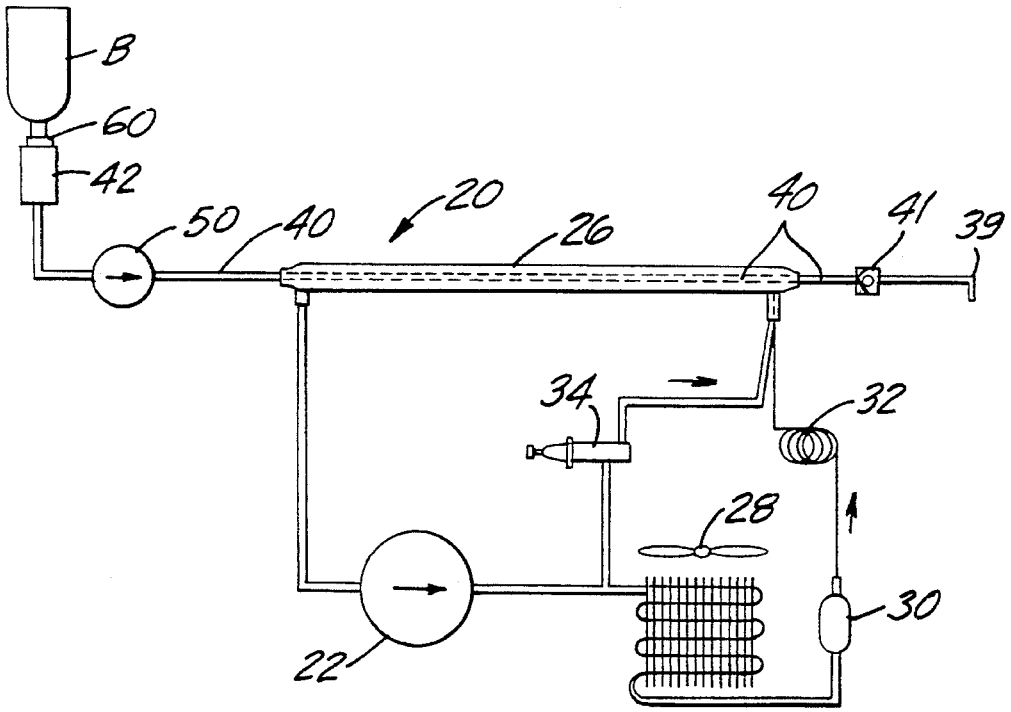
FIG. 5 is a schematic drawing of the cooling circuit.

As shown in FIG. 2, and in the schematic of FIG. 5, the machine 10 includes a refrigeration cooling unit, indicated generally at 20 contained within the housing 12. The refrigeration cooling unit 20 includes a compressor 22, condenser 24, evaporator coil 26, as well as a throttling device (not shown in detail), which together form a closed refrigeration circuit. The refrigeration cooling unit uses a conventional refrigerant liquid which expands to form a gas and condenses back to a liquid.

The compressor 22 compresses the low pressure gas to a high pressure gas and pumps the high pressure gas to the condenser 24. The condenser 24 converts the high pressure gas to high pressure liquid by extraction of heat from the gas. Heat is transferred to air passing over the condenser coil. A fan 28 forces air over the condenser 24 to aid in cooling. A drier/strainer 30 traps any residual moisture or contaminants in the system. The capillary tube 32 is a device to control flow of high pressure liquid entering the evaporator 26.

The evaporator coil 26 provides a low pressure chamber for the liquid refrigerant to evaporate. The evaporator absorbs heat from all surfaces within the evaporator including the tube containing the beverage. The hot gas valve 34 responds to evaporator pressure and bypasses the hot gas to the evaporator if the evaporator pressure is too low. The evaporator is designed for continuous operation at −10° F. The refrigeration cooling unit 20 also includes a start relay and overload protector 35 and refrigeration switch 36 as is common to these types of units.

In accordance with the present invention, a beverage faucet 39 is mounted on a side wall 16 of the housing and the beverage is dispensed therethrough. Inverted beverage containers, i.e. bottles B, are mounted on top of the housing. In the present illustrated embodiment, the beverage containers are shown as beverage bottles containing a high viscosity alcoholic beverage.

Figure 7:
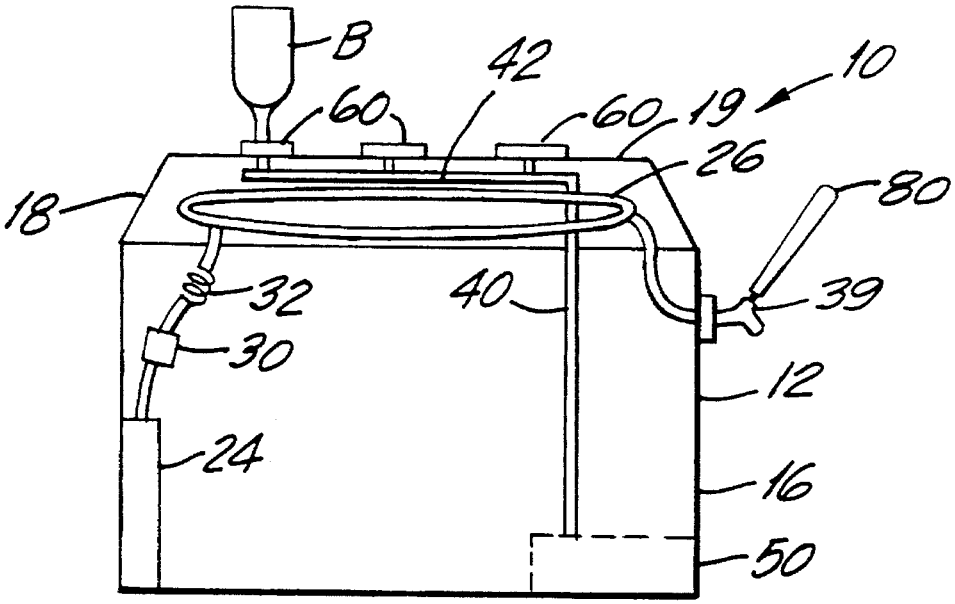
FIG. 7 is a schematic view of the chilled beverage line and pump in accordance with one embodiment of the present invention.
Figure 8:
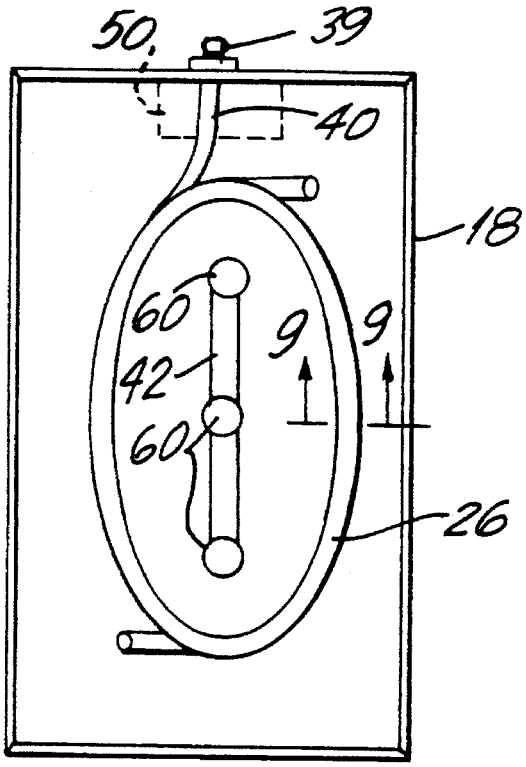
FIG. 8 is a plan view of the location of the chilled beverage line in accordance with one embodiment of the present invention.
Figure 9:
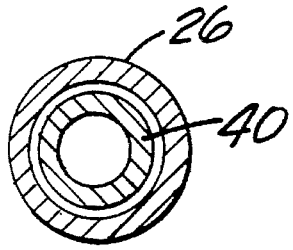
FIG. 9 is a sectional view of the chilled beverage line taken along line 9—9 of FIG. 8.

As shown in FIGS. 5 and 9, a beverage delivery tube 40 extends from a manifold 42 to the beverage faucet (FIG. 7. A portion of the beverage delivery tube 40 extends coaxial within the evaporator coil 26 (FIG. 9) so that the evaporator coil draws heat from the beverage delivery tube, thus cooling the beverage contained within the tube. This is advantageous because the overall housing is small, and thus during peak activity times, the beverage will be dispensed quickly. With a high viscosity and quick withdrawal of product, adequate cooling is essential. This portion of the beverage delivery tube 40 which is coaxial within the evaporator coil 26 forms with the evaporator coil 26 a chilled beverage line, i.e. a line where the beverage is chilled when the evaporator draws heat therefrom. Typically, the chilled beverage line is insulated so that the evaporator will not draw as much heat from the environment. A pump 50 is situated within the beverage delivery tube 40 and pumps the beverage from the manifold 42 to the beverage faucet 39, via a check valve flow restrictor 41, which regulates flow (FIGS. 2 and 5).

Typically, the evaporator coil is cut, and the beverage delivery tube inserted therein, and sealed by soldering. At the egress of the tube 40 from the coil, a cut is again soldered.

The chilled beverage line formed from the evaporator coil 26 and the beverage delivery tube 40 are horizontally disposed at a vertical height above the discharge faucet to facilitate withdrawal of beverage such as during maintenance. This is advantageous for thick beverages which have a consistency similar to thick honey when chilled down to 15° F. and thereabouts. The coaxial tube arrangement allows adequate cooling of beverage, even during high periods of use when the beverage is withdrawn quickly. The horizontal configuration prevents gas buildup in some areas during purging to facilitate maintenance.

Figure 3A:
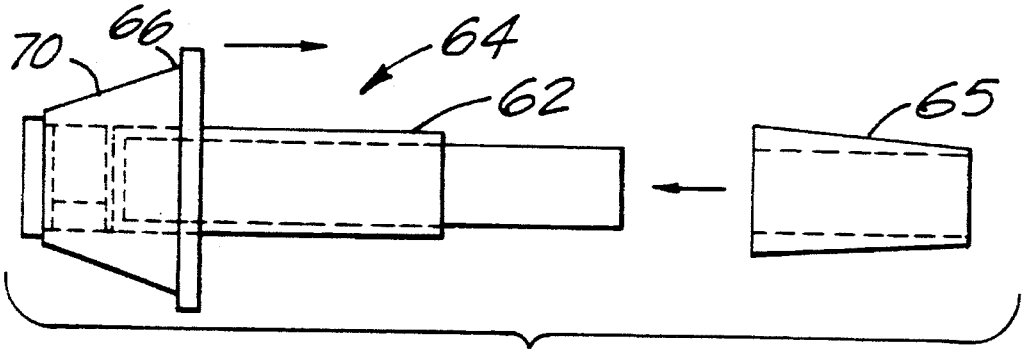
FIGS. 3A and 3B are plan views of the stopper shaft used in accordance with the present invention.

Referring now to FIGS. 3 and 4, there is illustrated in greater detail the mounting mechanism used for mounting the inverted bottles B onto the housing. As shown in FIGS. 2 and 5, the beverage manifold 42 is mounted within the housing adjacent to the top portion thereof. The beverage delivery tube 40 is connected to the manifold and receives beverage from the manifold, which in turn receives beverage from the inverted bottles.

A bottle mount 60 extends from the manifold 42 upward through the housing 12. Each bottle mount is configured for receiving a stopper shaft 62 of a bottle stopper, indicated generally at 64, which is inserted within a bottle B as shown in FIGS. 4A–4C.

Figure 3B:
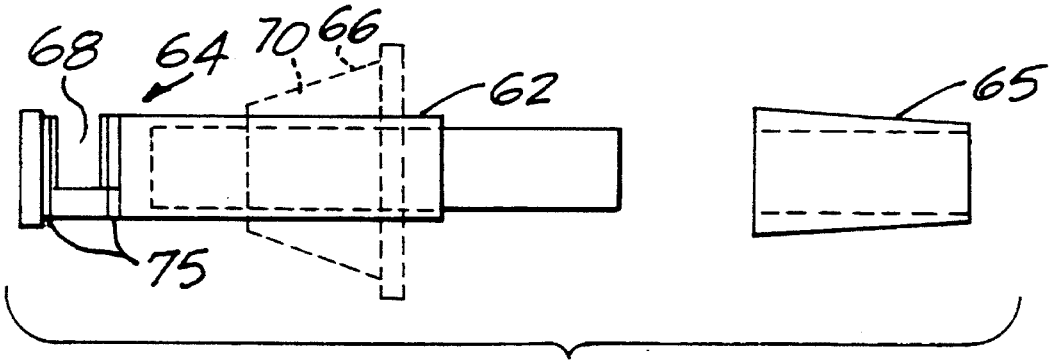

As shown in FIG. 3, the bottle stopper 64 is formed as a hollow shaft and includes a slidable collar 66 positioned on a medial portion of the stopper shaft 62. One end of the bottle stopper 64 is adapted for insertion into the neck of the bottle B and includes a tapered plug 65 which frictionally fits into the bottle opening. The other end has a side opening 68 (FIGS. 3B and 4C). The slidable collar 66 has a tapered portion 70 that engages a corresponding tapered portion 72 of the bottle mount. The collar 66 is movable on the stopper shaft from a closed position where the collar 66 covers the side opening 68 to prevent beverage withdrawal to an open 68 position where the collar uncovers the side opening to allow beverage withdrawal when that end is inserted within the bottle mount.

Figure 4A:
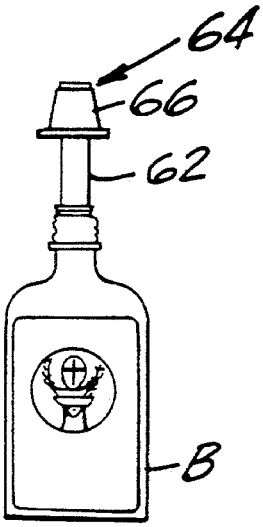
FIGS. 4A–4C shows the stopper shaft used with beverage bottles and supported on the bottle mounts of the machine housing.
Figure 4B:
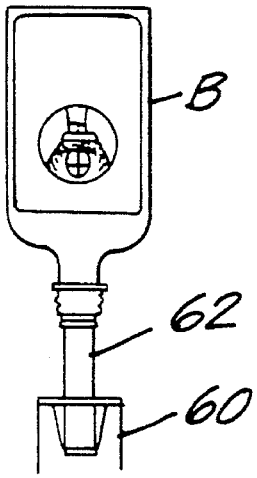
Figure 4C:
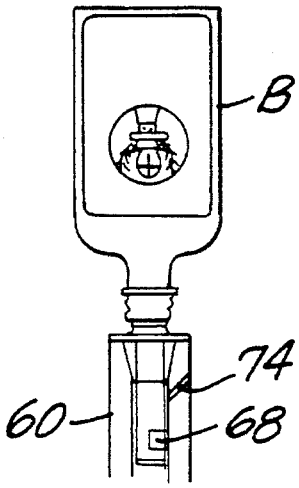

As shown in FIGS. 4A–4C, the collar 66 is moveable relative to the stopper shaft 62. When the stopper shaft 62 is inserted within a bottle mount 60, the bottle B is forced downward so that the side opening 68 becomes exposed. A vent hole 74 vents air to facilitate beverage withdrawal from the bottle B (FIG. 4C). An O-ring 75 is positioned above and below the side opening 68 to seal in a closed position.

The use of the bottle mounts and beverage manifold allows ready withdrawal of one bottle, without the necessity of replacing the other bottles. Also an adequate flow of beverage is maintained through the faucet. To ensure that the bottles B remain steady on top the housing, a bottle support cage 78 also supports the bottles.

Figure 6:
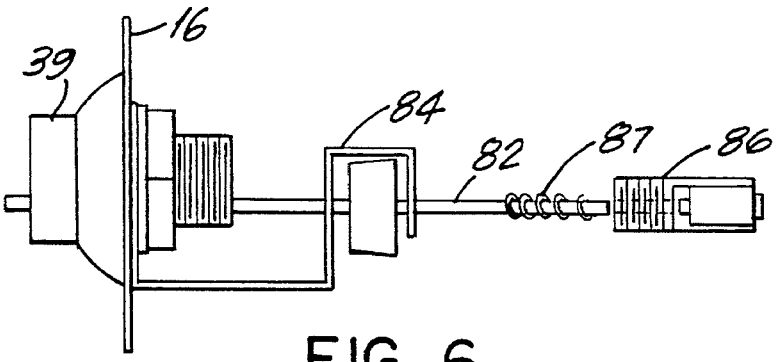
FIG. 6 is a schematic view of the push rod and handle assembly.
Figure 6A:
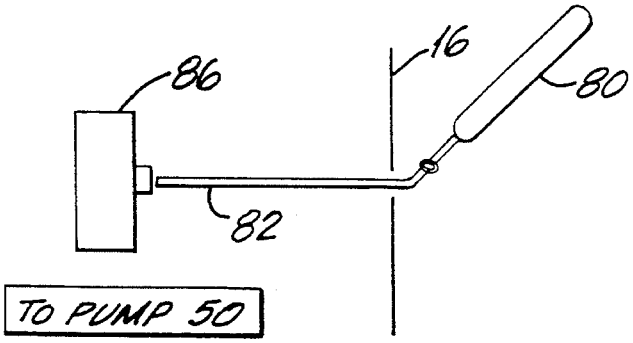
FIG. 6A is a schematic illustration of the push rod assembly.

As shown now in FIGS. 6, 6A and 2, the beverage faucet 39 includes a handle 80 and means interconnecting the pump and handle for actuating the pump when the handled is pulled for delivering beverage to the faucet. The interconnection means comprises a push rod 82 which is supported by a bracket 84 (FIG. 6). The push rod 82 engages an electrical switch 86 having an "on" and "off" state. The electrical switch 86 is electrically coupled to the pump 50 and operative in the "on" state for actuating the pump when the handle is forwardly pulled (FIG. 6A). A spring 87 is positioned on the push rod (FIG. 82) and biases the push rod 82 away from the switch 86 to ensure disengagement when required.

In operation the bottle stopper 64 is initially placed into the bottle opening at the bottleneck so that the stopper shaft is forced into a friction fit with the bottle opening. The collar and other end of the shaft are then inserted within the bottle mount on the housing. The bottle is pushed downward so that the shaft extends into the neck of the bottle mount. The vent hole allows air entry so that beverage will dispense into the manifold. At this time, the refrigeration cooling unit is working and drawing heat from the beverage delivery tube coaxial with the evaporator coil. The pump forces the beverage through the check valve flow restrictor 41, which regulates the beverage flow.

As shown in FIG. 6A, when the handle is pulled toward the user, the push rod is extended rearward to engage the switch and actuate the pump. The pump forces beverage through the beverage faucet.

It should be understood that the foregoing description of the invention is intended merely to be illustrative thereof, and that other embodiments, modifications, and equivalents may be apparent to those skilled in the art without departing from its spirit.

That which is claimed is:

1. A machine for dispensing chilled alcoholic beverage comprising a housing forming an enclosure and having an outer surface, a refrigeration cooling unit contained within said housing, said refrigeration cooling unit including a compressor, condenser and evaporator means, a beverage faucet mounted on the outer surface of said housing means for mounting at least one inverted beverage container on said housing, and including means associated with said mounting means for receiving beverage from said inverted beverage container, a beverage delivery means contained within said housing and operatively connected to said beverage faucet and beverage receiving means for delivering beverage from said beverage receiving means to said beverage faucet, and wherein a portion of said beverage delivery means extends within said evaporator means to form a chilled beverage means so that the beverage flowing through the beverage delivery means is chilled.

2. The machine according to claim 1 wherein said chilled beverage means includes an egress point from which the beverage delivery means exits from the evaporator means, and the egress point is positioned at a vertical height approximate to the vertical height of the beverage faucet.

3. The machine according to claim 1 wherein said chilled beverage means is horizontally oriented and positioned within the top portion of the housing at a vertical height approximate to the vertical height of the beverage faucet.

4. The machine according to claim 1 including a pump interposed within the beverage delivery means for pumping beverage to the beverage faucet.

5. The machine according to claim 1 wherein said evaporator means comprises an evaporator coil.

6. The machine according to claim 5 wherein said beverage delivery means comprises a beverage delivery tube.

7. The machine according to claim 6 wherein a portion of said beverage delivery tube extends coaxial within a portion of the evaporator coil.

8. A machine for dispensing chilled alcoholic beverage comprising a housing forming an enclosure and having side and top surfaces, a refrigeration cooling unit contained within said housing, said refrigeration cooling unit including a compressor, condenser and evaporator coil, a beverage faucet mounted on the outer side surface of said housing, means mounted in said housing for receiving beverage, a beverage delivery tube contained within said housing and being operatively connected to said beverage faucet and beverage receiving means for delivering beverage from said beverage receiving means to said beverage faucet, said beverage delivery tube extending coaxially within said evaporator coil to form a chilled beverage line so that the beverage flowing through the delivery tube is chilled, a pump mounted in said housing and operatively associated with said beverage delivery tube for pumping beverage through said tube to said beverage faucet, said beverage faucet including a handle pivotally mounted thereon, and being pivotally movable, electrical switch means mounted within said housing on the side surface opposite to the beverage faucet, and being operatively connected to said pump for actuating on-off operation of said pump, and a push rod extending from said handle to said switch, wherein said switch is responsive to pivoting movement of said handle so that said push rod engages said switch to actuate said pump.

9. A machine according to claim 8 wherein said push rod includes a spring for biasing said push rod away from said switch.

10. A machine according to claim 8 including a bracket supporting said push rod, and a spring for returning said push rod to an initial off position.

11. A machine according to claim 8 wherein said handle is pivotably movable in a forward direction toward a user, and said switch is responsive to forward pivoting movement of said handle.

* * * * *